US007284922B2

(12) United States Patent
Takami et al.

(10) Patent No.: US 7,284,922 B2
(45) Date of Patent: Oct. 23, 2007

(54) LABEL PRINTER

(75) Inventors: Toru Takami, Shiojiri (JP); Koji Yamada, Okaya (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 11/198,534

(22) Filed: Aug. 4, 2005

(65) Prior Publication Data

US 2006/0039737 A1 Feb. 23, 2006

(30) Foreign Application Priority Data

Aug. 9, 2004 (JP) ..... 2004-232774
Aug. 9, 2004 (JP) ..... 2004-232775

(51) Int. Cl.
*B41J 29/13* (2006.01)
*B41J 15/02* (2006.01)

(52) U.S. Cl. ..... 400/613; 400/693; 400/692

(58) Field of Classification Search ..... 400/611, 400/613, 619, 621, 691, 692, 693, 88, 120.01; 101/288, 228; 156/64, 277, 352, 378, 384, 156/584

See application file for complete search history.

(56) References Cited

U.S. PATENT DOCUMENTS 5,980,138 A 11/1999 Shiozaki et al. ..... 400/582
6,068,419 A 5/2000 Shiozaki et al. ..... 400/582
6,092,945 A * 7/2000 Takami et al. ..... 400/613
6,491,459 B2 * 12/2002 Hosomi ..... 400/613
6,505,981 B1 1/2003 Takami et al. ..... 400/617
2006/0165467 A1 * 7/2006 Kawakami et al. ..... 400/613

FOREIGN PATENT DOCUMENTS

JP 4-272876 9/1992
JP 8-295323 8/1996
JP 11314624 A * 11/1999
JP 2001-058743 3/2001
JP 2001063181 A * 3/2001
JP 2002-192786 7/2002
JP 2004-216611 8/2004

OTHER PUBLICATIONS 5-page European Search Report issued by the European Patent Office citing the above references.

* cited by examiner

*Primary Examiner*—Leslie J. Evanisko
(74) *Attorney, Agent, or Firm*—Anderson Kill & Olick, PC

(57) ABSTRACT

A label printer has an on-board peeling mechanism that easily replaces label paper and removing paper jams with limited space for opening and closing the printer. The label printer has a printing mechanism for printing labels while conveying label paper having a plurality of label affixed to a continuous web liner, and a peeling unit for peeling printed labels from the web liner conveyed through a curved transport path by bending the printed label paper acutely from the back side of the web liner. The peeling unit is attached to a printer cover which is mounted openably and closably to the label paper compartment in the printer housing.

7 Claims, 12 Drawing Sheets

LABEL PRINTER

BACKGROUND OF THE INVENTION

1. Field of Technology

The present invention relates to a label printer having a peeling mechanism for peeling printed labels from a web liner carrying the labels. In particular, the present invention relates to a label printer having a label peeling mechanism attached to a printer cover which is mounted for freely opening and closing with respect to the label paper compartment in the printer housing 2. Description of Related Art Label printers are used for printing labels with such information as a product name, price, and product code (barcode) for application to products. In the back room of a store, for example, such label printer is typically placed on a work table to print labels as the labels are affixed to the products. Label printers are also used to batch print multiple labels which are then taken to another location, such as the warehouse where the products are stored, for application to the individual products.

In the former application, a label peeling mechanism (also referred to simply as "peeling mechanism" hereinafter) is preferably used to automatically peel the labels one by one from the web liner as the labels are printed. Using a peeling mechanism in the latter method is even more desirable.

Label printers with such a peeling mechanism are disclosed in JP-A-4-272876, U.S. Pat. No. 5,980,138and JP-A-2004-21661, for example. These known label printers store, in a label paper compartment, a roll of label paper having labels affixed at a constant interval to the surface of a continuous web liner, and convey the labels past a printing mechanism for printing. The peeling mechanism conveys the label paper along a path bent at an acute angle thereby causing the printed labels to be gradually peeled one by one from the web liner and dispensed from a label dispenser opening.

This label dispensing mode of printing and peeling the labels one by one is referred to as the "peeling mode". Some label printers can also operate in another label dispensing mode referred to as "non-peeling", in which a specified number of labels are printed continuously without peeling the labels from the web liner.

Because the labels are dispensed in the non-peeling mode without being peeled from the web liner, the web transport paths downstream of the printing unit in the non-peeling mode and the peeling mode differ from each other. When loading label paper the user must therefore choose which paper transport path to use downstream of the printing unit depending on the desired label dispensing mode.

Different paper feed operations are also used depending on the label dispensing mode. More specifically, in the non-peeling mode the labels remain affixed to the web liner and the label paper is conveyed continuously to print and transport multiple labels without interruption. In the peeling mode, however, the label paper is conveyed intermittently, that is, it stops each time one label has been printed, and printing the next label starts after the previously printed label has been removed from the label dispenser opening. Printing and label paper transportation are thus intermittent operations. Thus, changing the dispensing mode requires more than simply changing the transport path, namely it also requires changing the paper feed control and printing control.

The known label printers described above have a cover mounted at the printer housing so that it can be opened and closed to expose or cover the label paper compartment. The cover can thus be opened to open the label paper compartment so that the label paper can be replaced. The cover can also be opened to open the paper transport path so that a paper jam can be removed.

The label printer taught JP-A-4-272876, for example, has a sheet cover disposed at the back side of the printer and a printer cover disposed at the front side of the printer. The sheet cover is used to open and close the label paper compartment of the printer, and the printer cover is used to open and close the printing mechanism and peeling mechanism of the printer. The problem with this arrangement is that both the sheet cover and the printer cover must be opened at the same time in order to load sheet label paper into the label printer. This requires operations at both the front and back of the printer, which is a bother.

Furthermore, the sheet cover must be large enough to allow replacing a roll of label paper. The printer thus requires a relatively large space to open and close the covers at the front and at the back. This is particularly a problem when it is necessary to open and close the printer covers in a limited working space such as on the work table where products are also placed for labeling.

When the peeling mechanism is housed inside the printer housing, opening and closing the covers to remove the web liner or labels jammed in the transport path of the peeling mechanism is particularly difficult.

SUMMARY OF THE INVENTION

The present invention provides a label printer overcoming the difficulties involved in the prior art and having a peeling mechanism with which loading label paper and removing paper jams can be accomplished easily and with limited space for opening and closing the printer.

A label printer according to an aspect of the present invention has a printing mechanism for printing labels while conveying label paper having a plurality of labels affixed to a continuous web liner, and a label peeling mechanism for peeling printed labels from the web liner conveyed through a curved transportation path by bending the printed label paper acutely from the back side of the web liner. The label peeling mechanism is attached to a printer cover which is mounted freely to open and close with respect to the label paper compartment in the printer housing.

Because the peeling mechanism is disposed on the printer cover in this label printer, opening the printer cover opens the label paper compartment inside the printer housing and simultaneously exposes the peeling mechanism for access from outside the printer housing.

This makes replacing and loading the label paper in the label printer with the peeling mechanism simple, and makes it easy to remove the web liner or labels jammed in the transport path (included in the peeling mechanism) of the labels easy. More particularly, this arrangement improves productivity because the user can do all of these operations from the front side (printer cover side) of the printer, that is, the side of the printer that is faced by a user when using the printer.

Furthermore, when the label dispensing mode is changed between the peeling mode and the non-peeling mode, the peeling mechanism is opened while the printer cover remains closed, the label paper is set to the desired transport path, and the peeling mechanism is then simply closed. In the back room operations of a store, for example, the peeling mode is often used to print and apply labels to products, but multiple labels may also be batch printed and taken to a warehouse or other location for application to the products. In this case the printer cover can be left closed while opening and closing only the peeling mechanism to reroute the label paper for printing in the non-peeling mode.

Preferably, means are provided preventing the printer cover from being opened unless the peeling mechanism is open. As a result, the user is automatically forced to first open the peeling mechanism before opening the printer cover, and the printer cover cannot be accidentally opened to change the label dispensing mode. The position of the label paper will thus not shift, and label paper waste (the necessity of advance to the correct position) can be prevented. Problems caused by reversing the above-described opening sequence can thus be prevented by eliminating errors in the sequence in which the peeling mechanism and printer cover are opened.

A shutter is preferably provided to prevent the printer cover from being opened unless the peeling mechanism is open. The shutter is movable to either enable or disable operation of an opening operator. The opening operator is an element such as a lever used to operate the printer cover. The shutter is moved in conjunction with the opening and closing of the peeling mechanism.

Operation of the opening operator can thus be reliably controlled by means of a simple construction. Furthermore, when the shutter designed to indicate whether operation is allowed or not allowed is provided for an opening operator that the user operates directly with a finger, the opening operator will not be mistakenly operated and unnecessary force will not be applied to the opening operator and/or the printer cover.

Furthermore, because the peeling mechanism can be opened and closed freely relative to the printer cover, the web transport path can be changed in the peeling mechanism by opening only the peeling mechanism without opening the printer cover. The user can therefore easily change the web transport path with limited space for accessing the transport path.

Preferably, the peeling mechanism can be reliably locked in the closed position, so that it will not open accidentally even if significant tension is applied to the peeling mechanism when cutting the web liner discharged from the web discharge slot in the peeling mode or the label dispensing slot in the non-peeling mode by a manual cutter at each slot.

The printing mechanism of this label printer has a print head such as a thermal head mounted in the printer housing and a platen roller mounted on the printer cover for pressing the label paper to the print head. The platen roller and the print head hold the label paper when the printer cover is closed. Opening the printer cover releases the label paper and the position of the label paper can thus shift when the printer cover is closed again. The label paper must therefore be advanced to position the next label correctly so that the label can be printed at the desired position by the print head. Multiple labels may be wasted by this positioning. An advantage of a label printer according to a preferred embodiment of the present invention is that the label dispensing mode can be changed by opening only the peeling mechanism while the printer cover remains closed. The position of the label thus does not shift and label paper waste is eliminated.

FIG. 7 to

Figure 1:
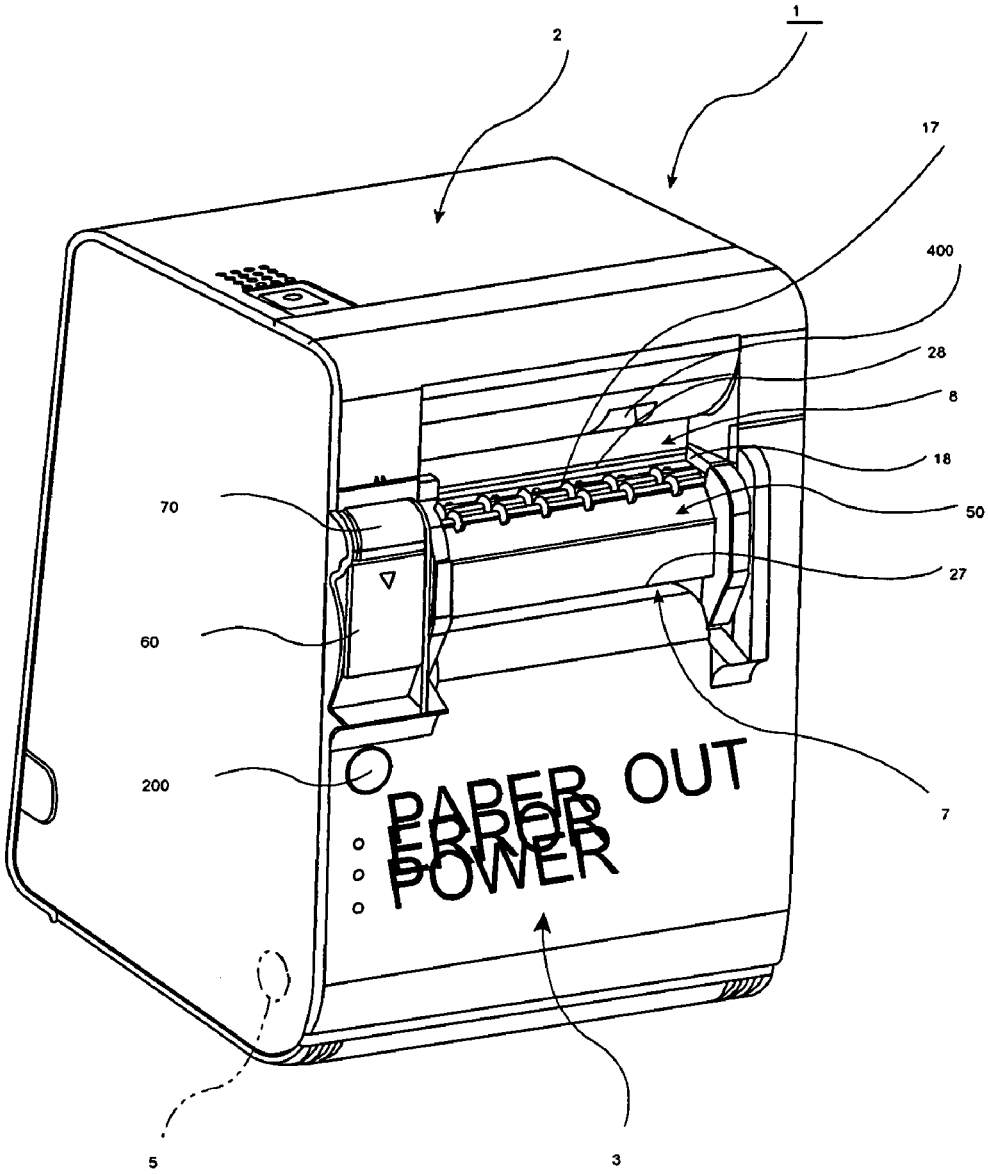
FIG. 1 is an perspective outer view of a label printer according to an embodiment of the present invention with the printer cover and peeling unit closed.
Figure 11:
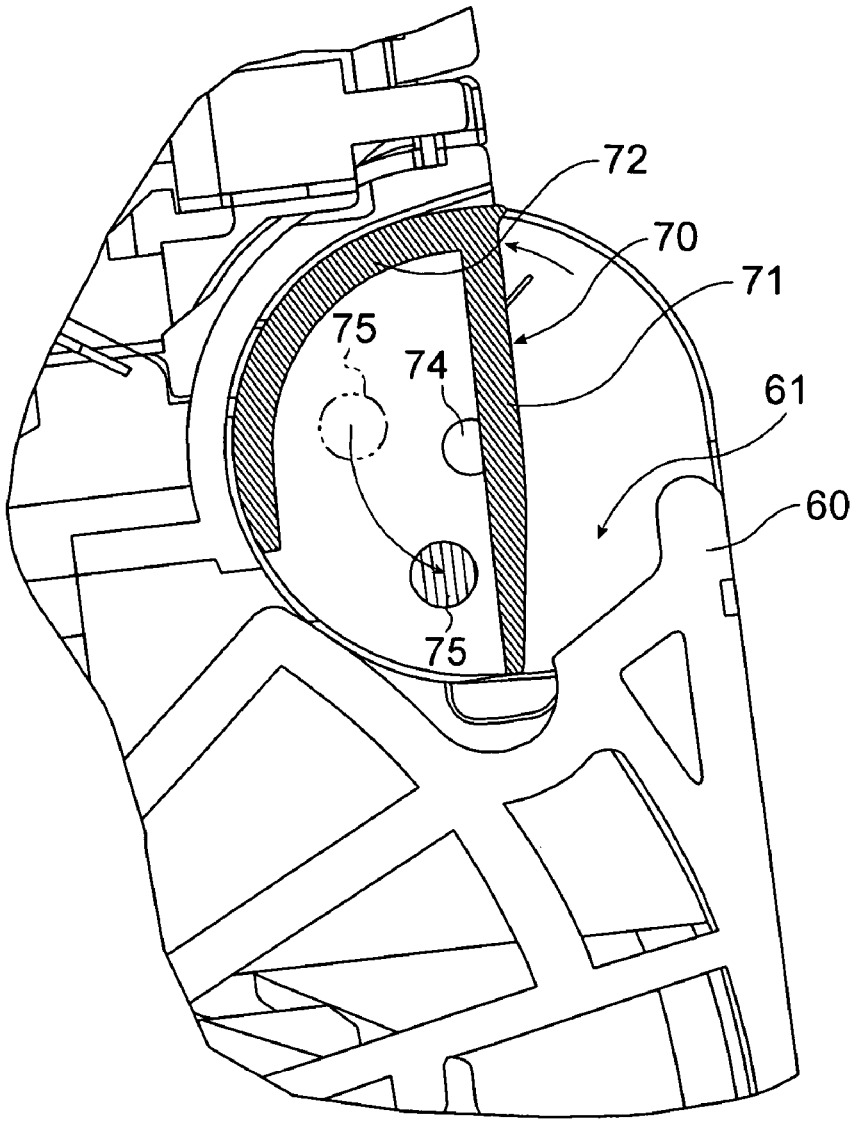
Figure 12A:
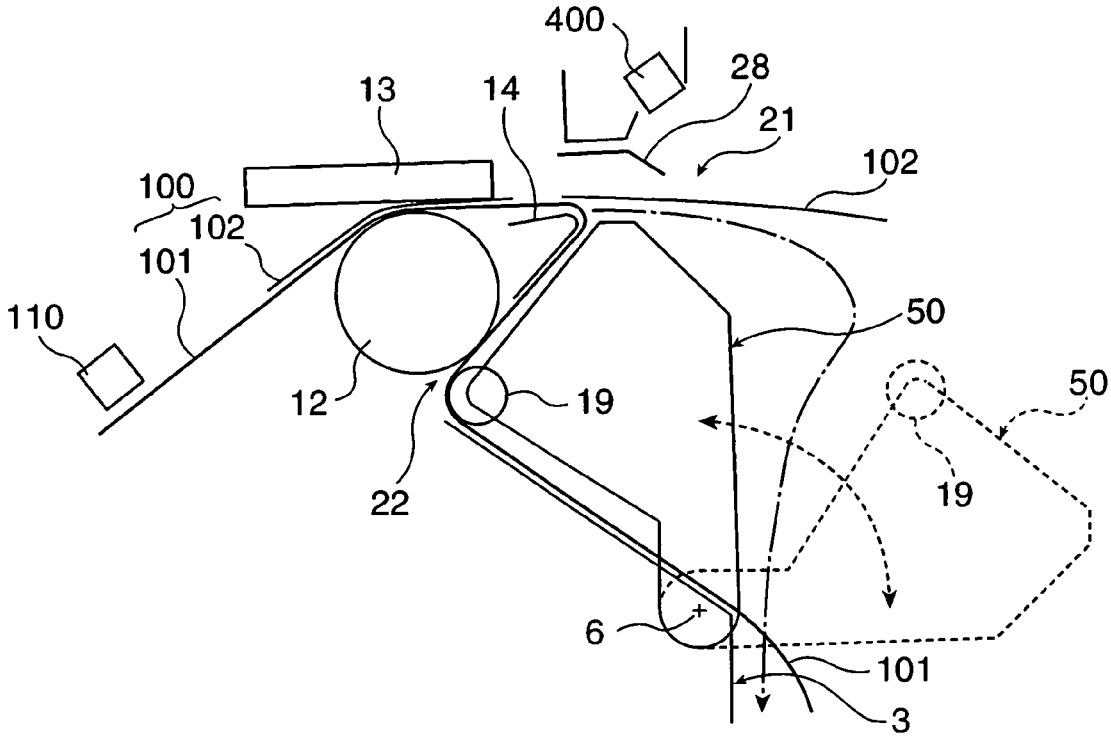
Figure 12B:
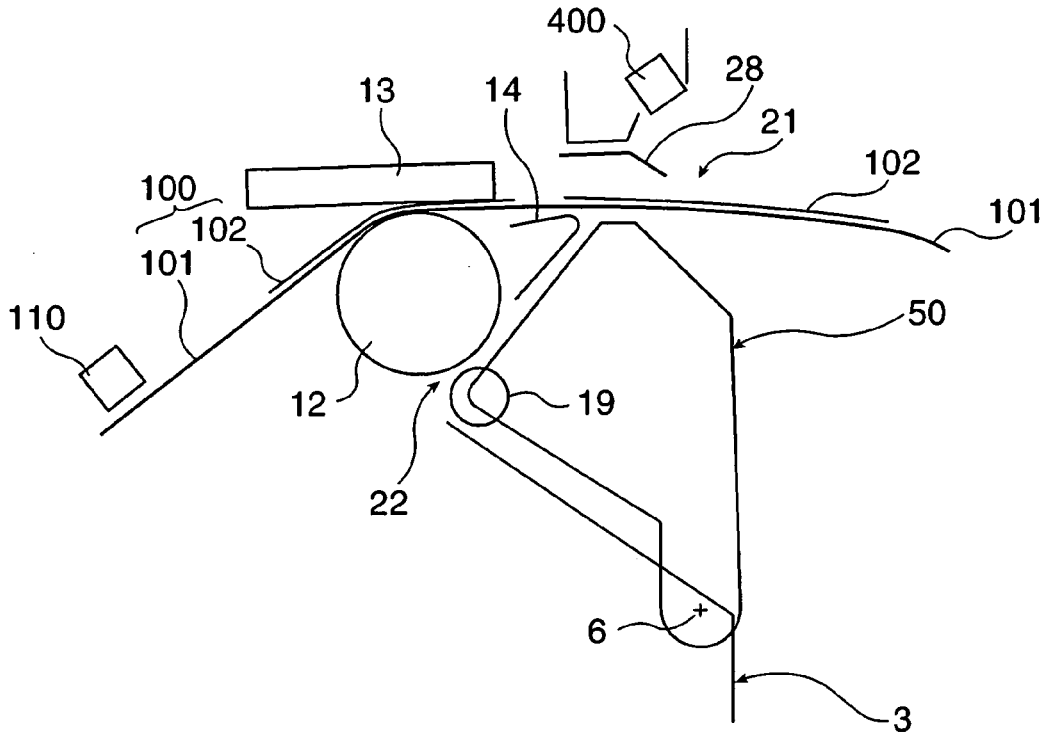

FIG. 11 are a partial side sectional views showing the relationship between the printer cover release lever and the shutter when the peeling unit release lever is operated in the label printer shown in FIG. 1;

FIG. 12A is a schematic diagram showing the differences between the label paper transport paths in the different label dispensing modes of the label printer shown in FIG. 1, and more particularly shows the transport path in the peeling mode; and FIG. 12B is a schematic diagram corresponding to FIG. 12A but showing the transport path in the non-peeling mode.

DETAILED DESCRIPTION OF THE PREFERRED EMBODIMENTS

A label printer according to a preferred embodiment of the present invention is described below with reference to the accompanying figures.

Figure 2:
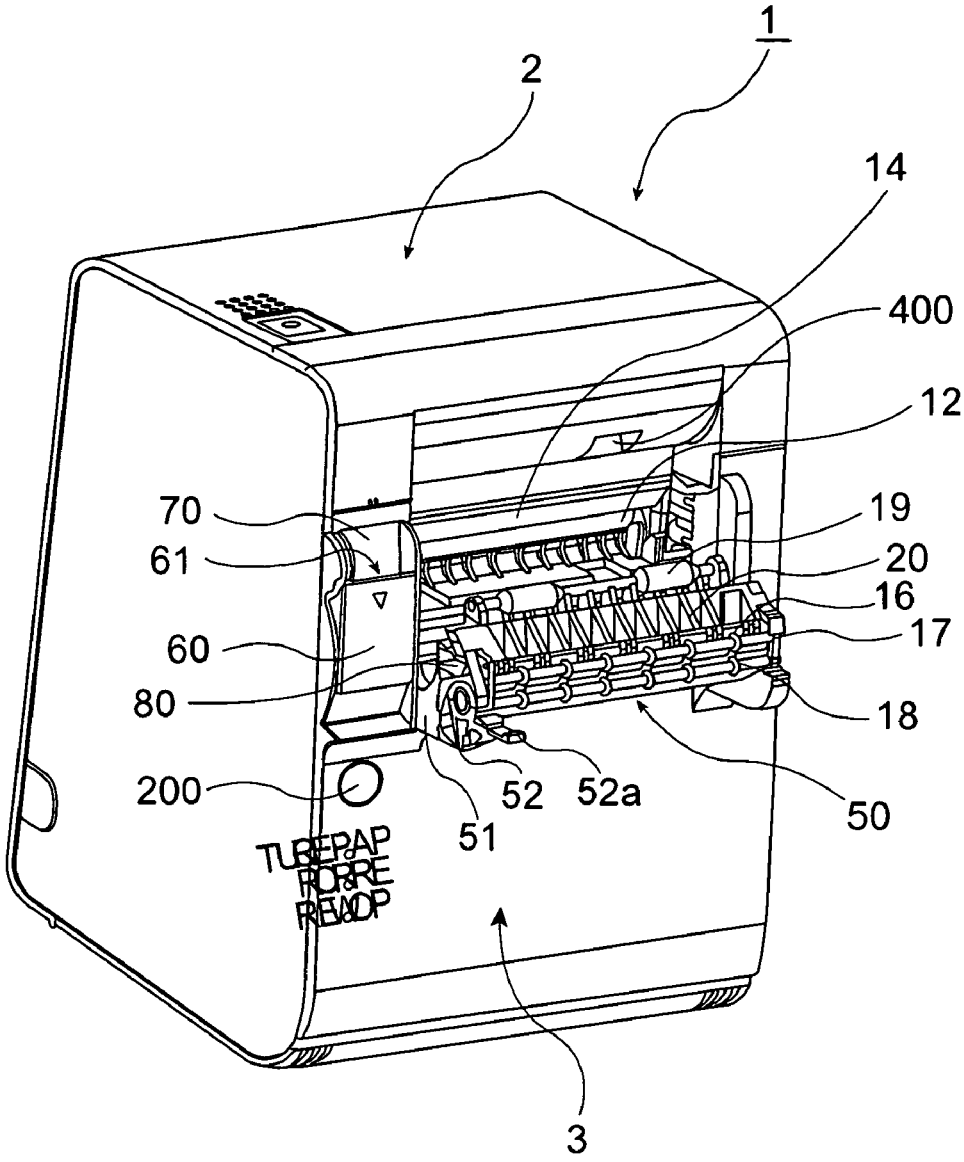
FIG. 2 is the same view as in FIG. 1 but with the peeling unit open.
Figure 3:
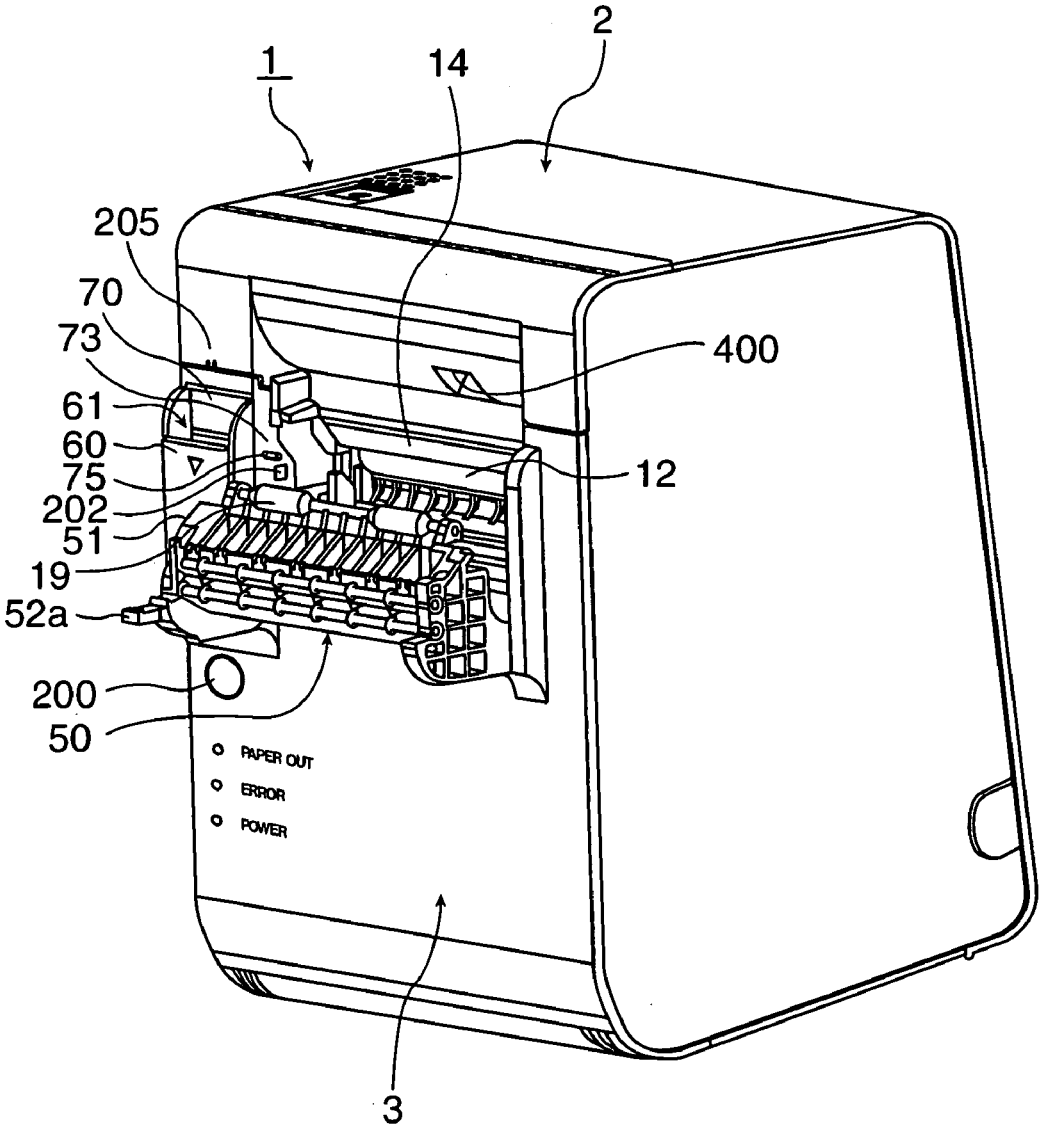
FIG. 3 is a perspective view similar to that in FIG. 2 but seen from a different angle.
Figure 4:
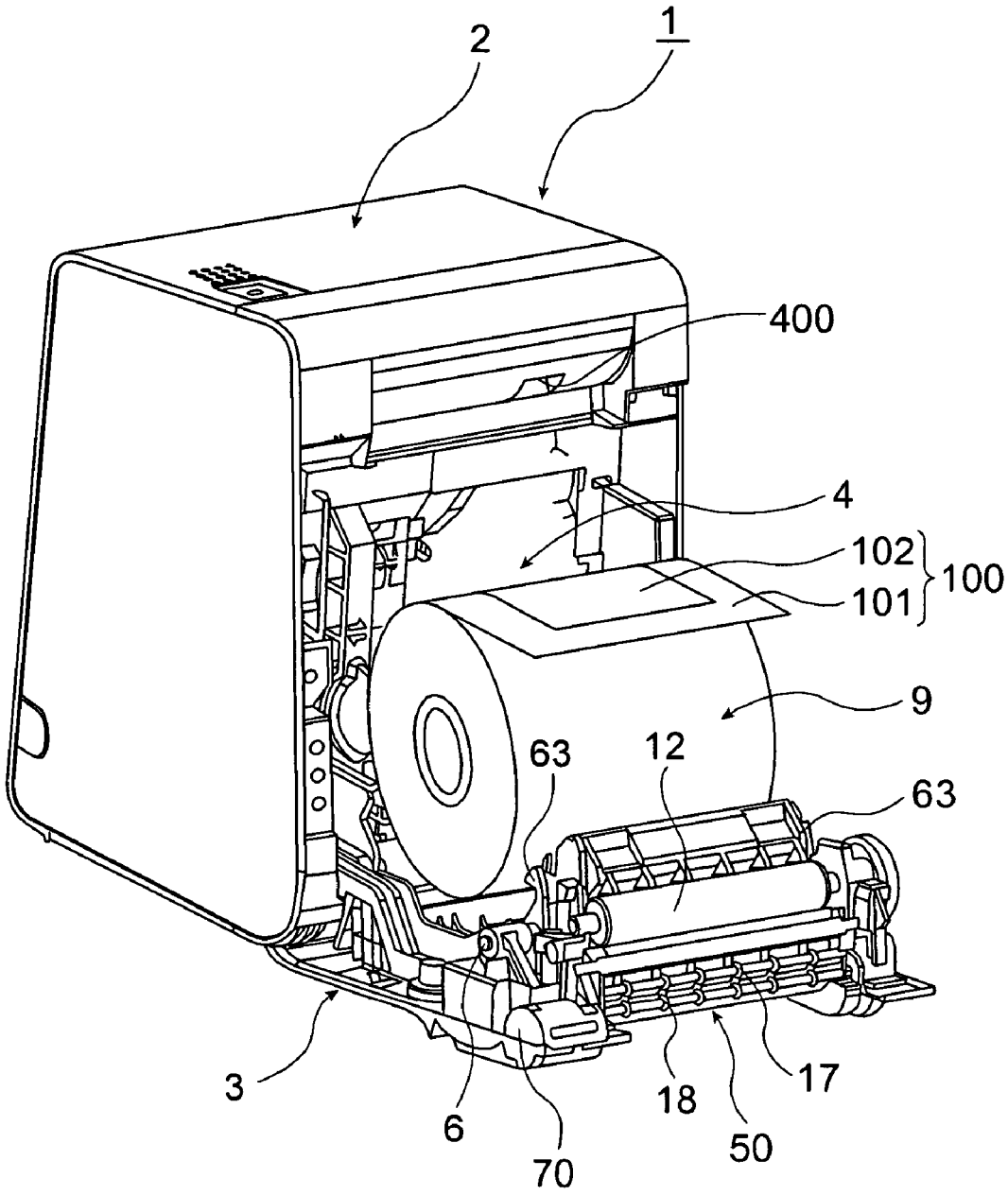
FIG. 4 is the same view as in FIG. 1 but with the printer cover open.
Figure 5:
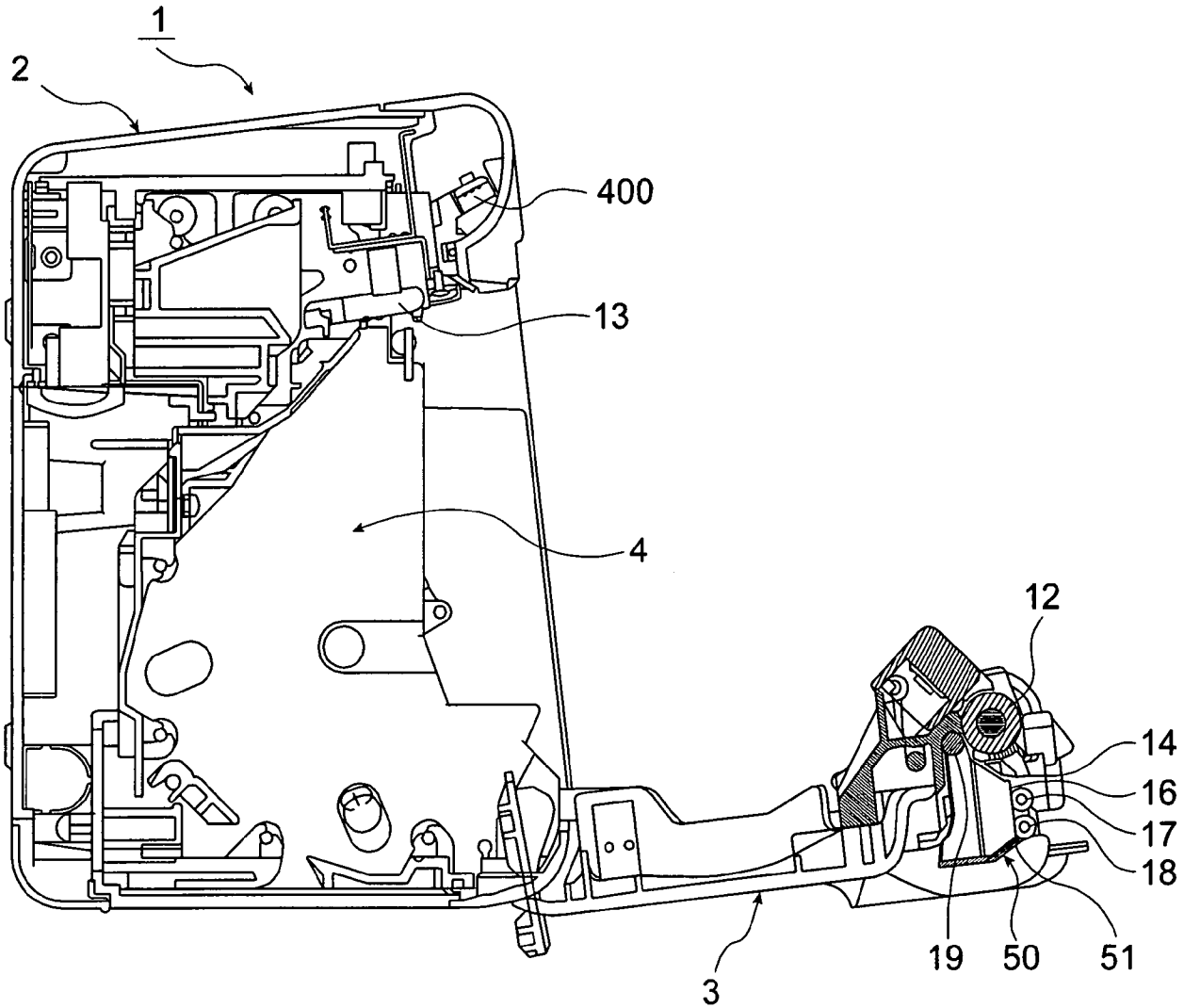
FIG. 5 is a side sectional view of the label printer shown in FIG. 4.

As shown in FIG. 1 to FIG. 5, a label printer 1 according to this embodiment of the invention has a printer housing 2 with a basically parallelepiped shape. A label paper compartment 4 is located inside the printer housing 2 to accommodate a roll 9 of label paper 100. A printer cover 3 for widely opening the compartment 4 (see FIG. 4 and FIG. 5) is arranged at the front side of the printer housing 2 so that the printer cover 3 can be opened and closed. The label paper as this term is used in this text comprises multiple labels 102 peelably affixed to a continuous web liner 101 of a specific width (FIG. 4). Note that the "label paper" need not really be "paper". Instead, the web liner and/or the labels may be of any material suitable for the respective purpose.

The printer cover 3 is connected to the printer housing 2 at the bottom by means of a rotary shaft 5 or any other suitable pivot mechanism enabling the printer cover 3 to pivot freely. A label dispensing slot 8 for dispensing printed labels is formed at the top of the printer cover 3, and a web discharge slot 7 for discharging in the peeling mode the web liner 101 from which the labels have been removed is formed below the label dispensing slot 8.

Figure 6:
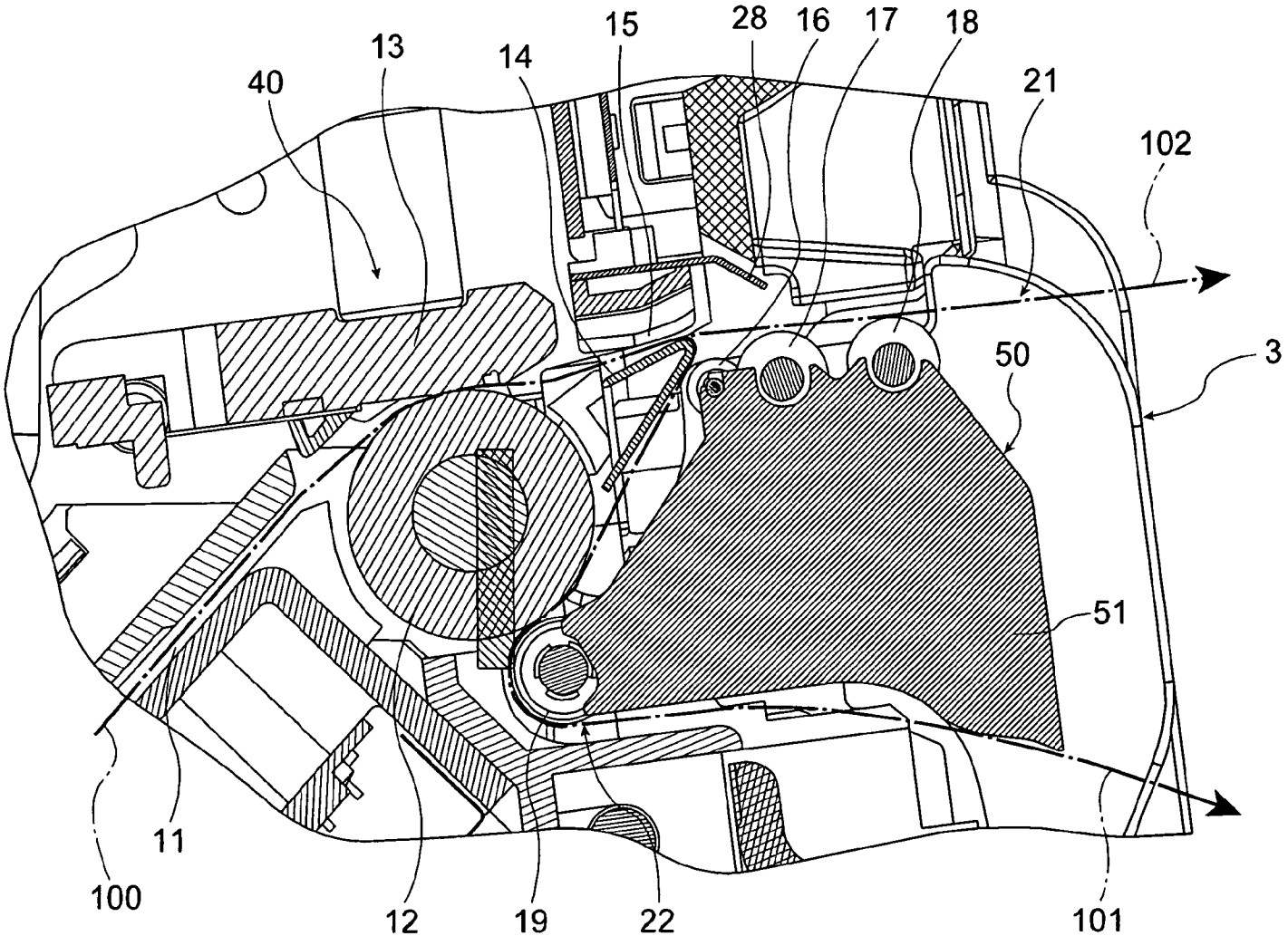
FIG. 6 is a partial side sectional view showing the major internal elements of the label printer shown in FIG. 1.

A printing mechanism 40 for printing labels 102 while conveying the label paper 100 (see FIG. 4 and FIG. 6) is disposed inside the printer housing 2 as shown in FIG. 6. The printing mechanism 40 in this embodiment has a thermal print head 13 mounted to the printer housing 2 and a platen roller 12 mounted to the printer cover 3 for pressing the labels of the label paper 100 against the print head 13. The label paper is held between the platen roller 12 and the print head 13 and is advanced by rotating the platen roller 12. Labels 102 are printed by driving the print head 13 while advancing the label paper 100.

A peeling unit 50 (peeling mechanism) is installed on the printer cover 3 at the top portion thereof. The peeling unit 50 is pivotally supported on a rotary shaft 6 or by any other suitable pivot mechanism at the bottom of the peeling unit 50 (see FIG. 4) so that the peeling unit can be freely turned between an open and a closed position relative to the printer cover 3. The label dispensing slot 8 is rendered between the top edge of the peeling unit 50 and the wall of the printer housing 2. The web discharge slot 7 is rendered between the printer cover 3 and the bottom edge of the peeling unit 50.

A web cutter 27 is disposed at the web discharge slot 7, and a peeled-label detector 400 and a manual cutter 28 are disposed at the label dispensing slot 8.

In the peeling mode, the peeling unit 50 gradually peels the printed labels 102 from the web liner 101 starting from the leading edge of a label 102 while the label paper travels through a curved transport path defined by a web-bending guide 14 (see FIG. 6) against which the rear side of the web liner 101 (the side opposite to the label-carrying side) of the label paper 100 is pressed so that the web liner curves around a "peeling edge" defined by an acute angle of the web-bending guide 14.

Closing the peeling unit 50 (to the normal operating position) forms a label-guiding path 21 for guiding labels 102 peeled from the web liner 101 to the label dispensing slot 8 (see FIG. 1 and FIG. 6), and a web-guiding path 22 for guiding the web liner 101 to the web discharge slot 7 and discharging the web liner (see FIG. 1 and FIG. 6) from which the labels 102 have been removed. Opening the peeling unit 50 opens and externally exposes the label-guiding path 21 and the web-guiding path 22.

A web pressure roller 16, a label discharge roller 17, a label guide roller 18, and a peeling roller 19 are disposed freely rotationally at a housing 51 of the peeling unit 50 to form the label-guiding path 21 and the web-guiding path 22 as shown in FIG. 6.

The peeling roller 19 holds and presses the web liner 101 to the platen roller 12, thus rotates following rotation of the platen roller 12, and cooperates with the platen roller 12 to transport the web liner 101 along the web-guiding path 22.

The peeling unit 50 is held in the closed position by the peeling roller 19, which engages the peripheral surface of the platen roller 12 at a contact point of the peeling roller whose locus described as the peeling unit is turned to the open position intersects the periphery of the platen roller.

The web pressure roller 16 is disposed adjacent to the guide surface of the web-bending guide 14 downstream of the peeling edge, thus pressing the web liner 101 to the web-bending guide 14 and rotating in conjunction with web travel.

The label discharge roller 17 is disposed freely rotationally near the downstream side of the peeling edge of the web-bending guide 14. The label discharge roller 17 may be linked, by means of a power transfer mechanism such as a gear train, not shown, to the peeling roller 19 so that the label discharge roller 17 is driven by rotation of the peeling roller 19, and when thus linked conveys the labels 102 peeled from the web liner 101.

The label guide roller 18 is disposed freely rotationally at substantially the same height as the label discharge roller 17 on the label dispensing slot 8 side, and holds the peeled labels 102.

The peeled labels 102 could be held by only the label discharge roller 17 or only the label guide roller 18. The peeled labels 102 are detected by the peeled-label detector 400.

Ribs 15 are disposed above and opposite the web-bending guide 14 to press the label paper 100 down from above. A manual cutter 28 for cutting, in the non-peeling mode, the web liner 101 of the printed label paper 100 as needed is disposed above the label discharge roller 17.

Ribs 20 forming part of the web-guiding path 22 are disposed at the housing 51 between the peeling roller 19 and web pressure roller 16 (see FIG. 2). The ribs 15 and ribs 20 reduce the contact area with the labels 102 and web liner 101, respectively, and thus reduce the adhesion of adhesive from the labels.

As mentioned before, when the platen roller 12 is in its operating position, the print head 13 and the platen roller 12 are on opposite sides of the transport path 11 of the label paper 100, and the platen roller 12 presses the label paper 100 to the print head 13 while conveying the paper to the downstream side.

The platen roller 12 and the web-bending guide 14 are disposed at the printer cover 3, and opening the printer cover 3 thus opens the transport path 11. The label paper 100 held between the platen roller 12 and print head 13 is then released.

A label printer 1 according to this embodiment can be used in either of two label dispensing modes: a peeling mode and a non-peeling mode (continuous label dispensing mode).

In the peeling mode as shown in FIG. 12A, the printed labels 102 are peeled from the web liner 101, and the labels 102 and the web liner 101 are respectively discharged from the label dispensing slot 8 and the web discharge slot 7 along the label-guiding path 21 and the web-guiding path 22. The open position of the peeling unit 50 is shown a dotted line in FIG. 12A.

In the non-peeling mode as shown in FIG. 12B, the label paper 100 (including the web liner 101) is conveyed through the label-guiding path 21 and discharged from the label dispensing slot 8 without the printed labels 102 being peeled from the web liner 101.

Switching between these modes is achieved by opening the label-guiding path 21 and the web-guiding path 22 and changing the path to which the web liner 101 is loaded.

As shown in FIG. 1, a printer cover release lever 60 for opening the printer cover 3 is disposed as an opening operator on one side of the printer cover 3. This lever 60 is linked to a locking arm 63 shown in FIG. 4. When the user pulls the top of the lever 60 forward with a finger, the locking arm 63 rotates and disengages from an engaging portion (not shown) inside the printer housing 2, thus allowing the printer cover 3 to open. When the printer cover 3 is closed, the locking arm 63 automatically engages this engaging portion and thus locks the printer cover in the closed state.

Figure 8:
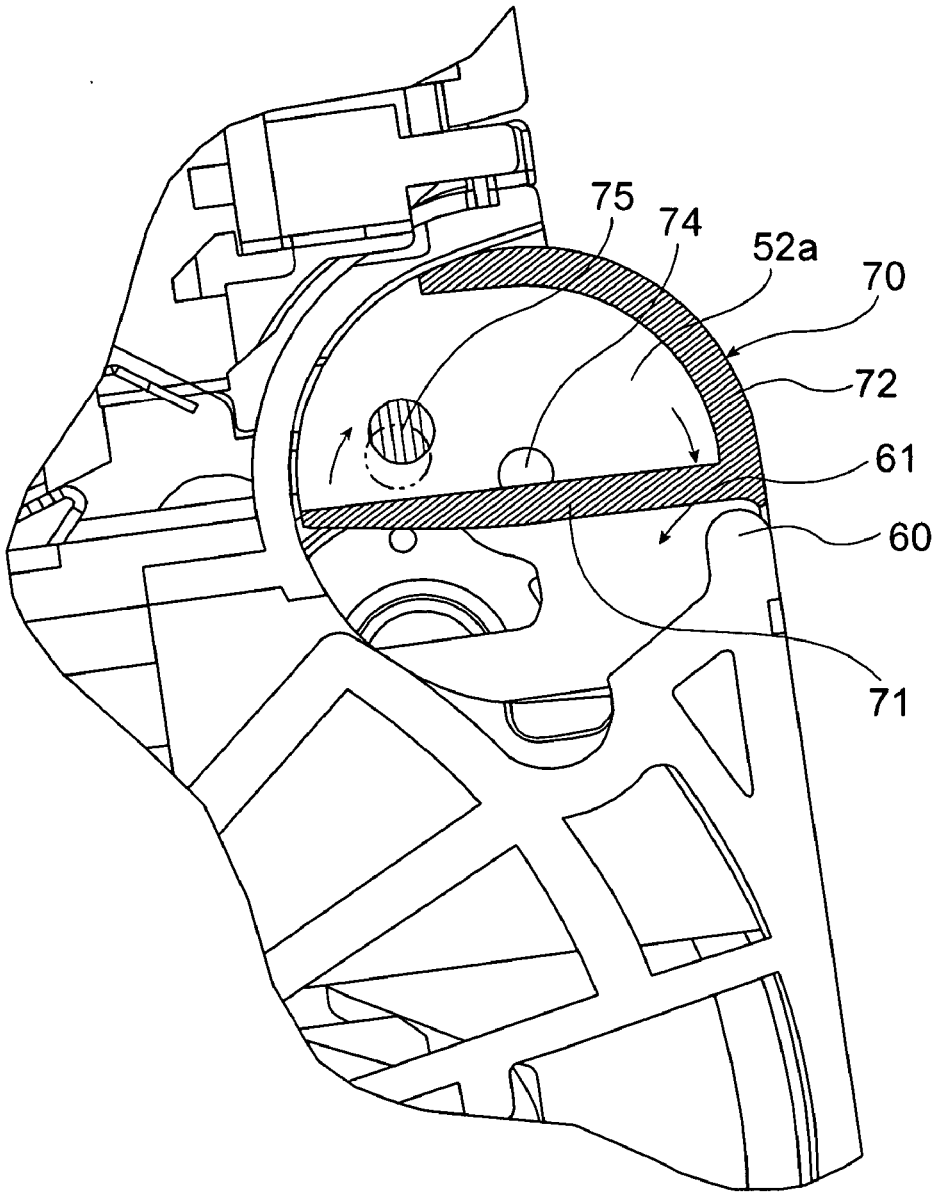

A recessed portion 61 (see FIG. 2 and FIG. 8) for grasping the top edge of the lever 60 is provided behind the top of the lever 60 as shown in FIG. 8. A shutter 70 (operation limiting mechanism) is disposed in the recessed portion 61 to prevent the user from accidentally catching the top edge of the lever 60 with a finger.

The shutter 70 can pivot between a position closing the recessed portion 61 as shown in FIG. 1 and FIG. 8, and a position opening the recessed portion 61 as shown in FIG. 2 and FIG. 11. The shutter 70 is assembled to operate in conjunction with operating a peeling unit release lever 52 which opens and closes the peeling unit 50 shown in FIG. 7.

Figure 7:
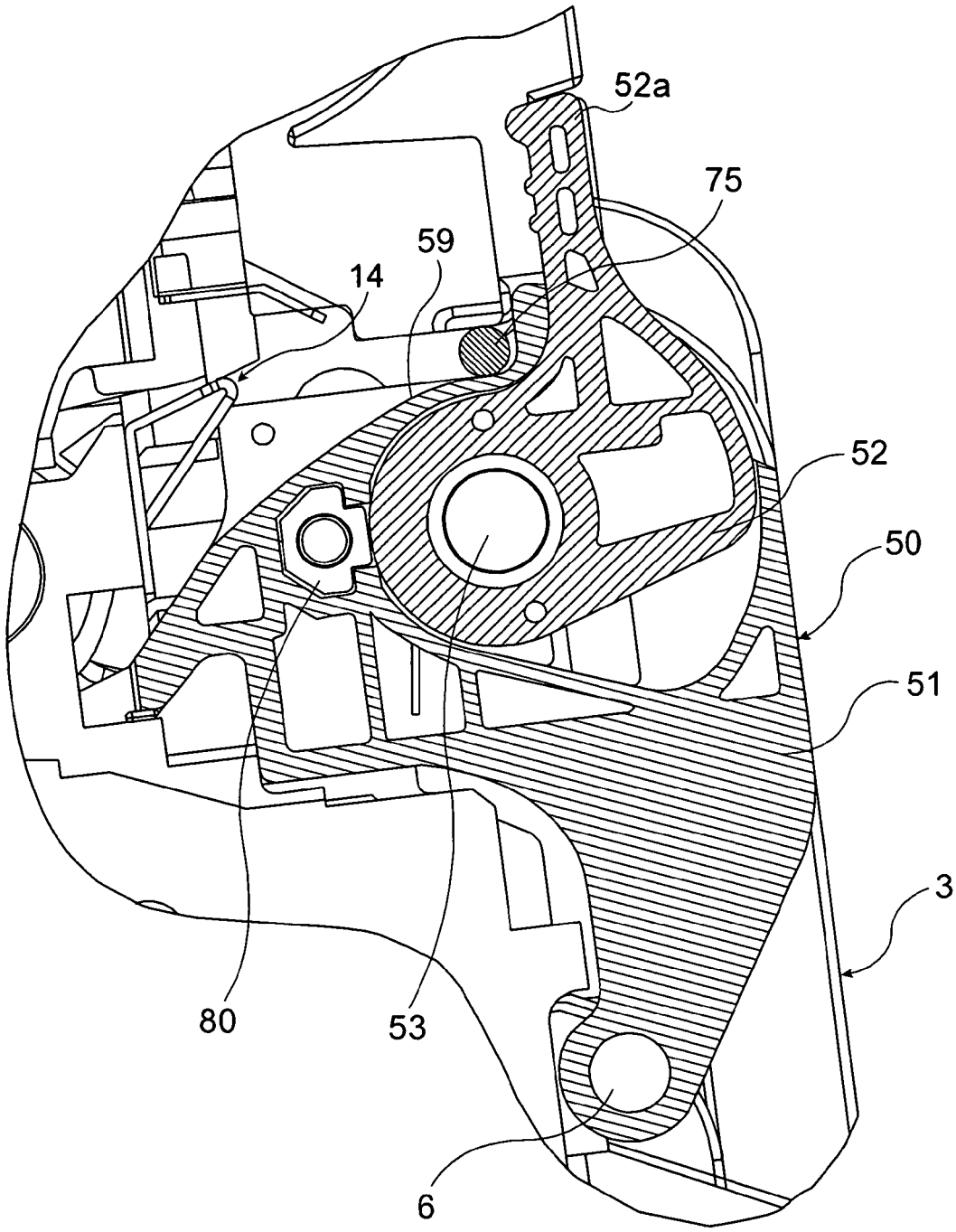

As shown in FIG. 7, the release lever 52 rotates on and is attached to the housing 51 of the peeling unit 50 by a support shaft 53 and, as shown in FIG. 2 is located beside the printer cover release lever 60 at the side of the peeling unit 50.

Figure 9:
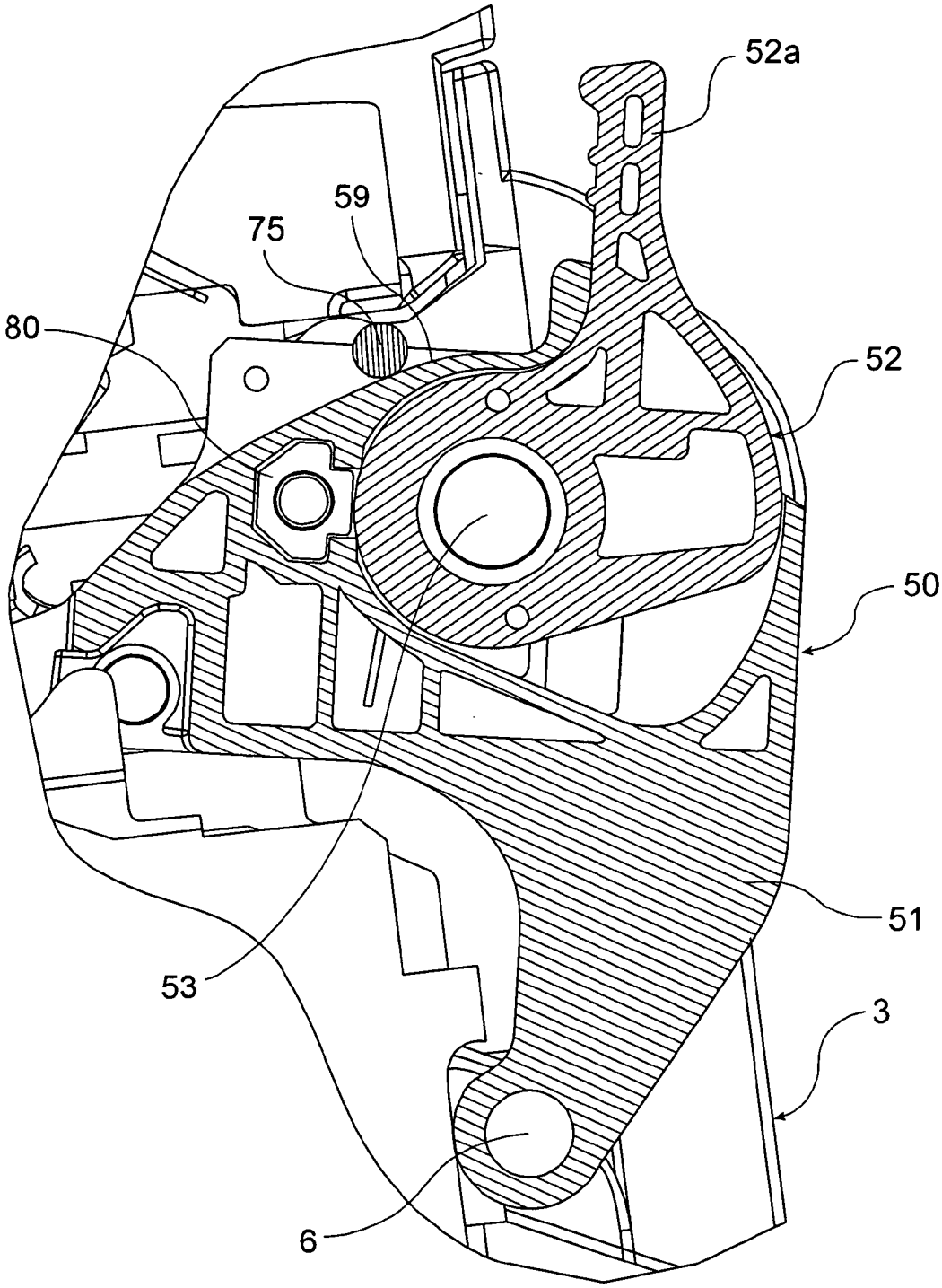

As shown in FIG. 9, the peeling unit 50 can be opened by hooking a finger on the top end portion 52*a* of the lever 52 and pulling the lever 52 forward.

A locking unit 80 is disposed at the peeling unit 50 as shown in FIG. 2 for locking the peeling unit 50 in its closed position relative to the printer cover 3. This locking unit 80 is linked to the lever 52 and thus operates in conjunction with rotation of the lever 52 relative to the peeling unit 50.

When the user closes the peeling unit release lever 52, the locking unit 80 moves in the direction protruding to and engaging an engaging portion (not shown in the figure) inside the peeling unit 50 in conjunction with the direction of rotation of the lever 52 and thus locks the latter.

When the lever 52 is opened, the locking unit 80 moves in the direction retracting inside the peeling unit in conjunction with the direction of rotation of the lever 52, and thus unlocks the printer cover 3.

Because the peeling unit 50 can thus be reliably locked in the closed position, the peeling unit 50 will not open accidentally even if significant tension is applied to the peeling unit 50 such as when cutting the web liner 101 discharged from the web discharge slot 7 by a web cutter 27 in the peeling mode or by manual cutter 28 in the label dispensing slot 8 in the non-peeling mode.

As shown in FIG. 8, the shutter 70 in the recessed portion 61 behind the printer cover release lever 60 is a substantially semicircular tube whose peripheral wall has a curved wall portion 72 continuously covering from the top edge of the lever 60 to the entrance to the recessed portion 61 (disable accessing the printer cover release lever 60) and a straight wall section 71 in a radial plane of the tube. The shutter 70 moves circularly inside the recessed portion 61 on a shaft 74 disposed at the middle of the straight wall 71. This shutter 70 moves circularly in the same plane of rotation as the printer cover release lever 60, and is rotationally urged by a spring member (not shown in the figure) to the position, shown in FIG. 11, opening the recessed portion 61 (enable accessing the printer cover release lever 60).

A pin 75 is fit in the outer surface of an end wall 73 of the shutter 70. As shown in FIG. 3, this pin 75 protrudes into the storage space of the housing 51 of the peeling unit 50, and engages a cam channel 59 formed on the housing 51 (see FIG. 7 and FIG. 9).

When the peeling unit 50 is closed to the printer cover 3 from the open position and housed in the storage space, the cam channel 59 raises the pin 75 as shown in FIG. 7. As the pin 75 moves, the shutter 70 turns clockwise as seen in FIG. 8 around shaft 74, and the curved wall 72 closes the entrance to the recessed portion 61.

Figure 10:
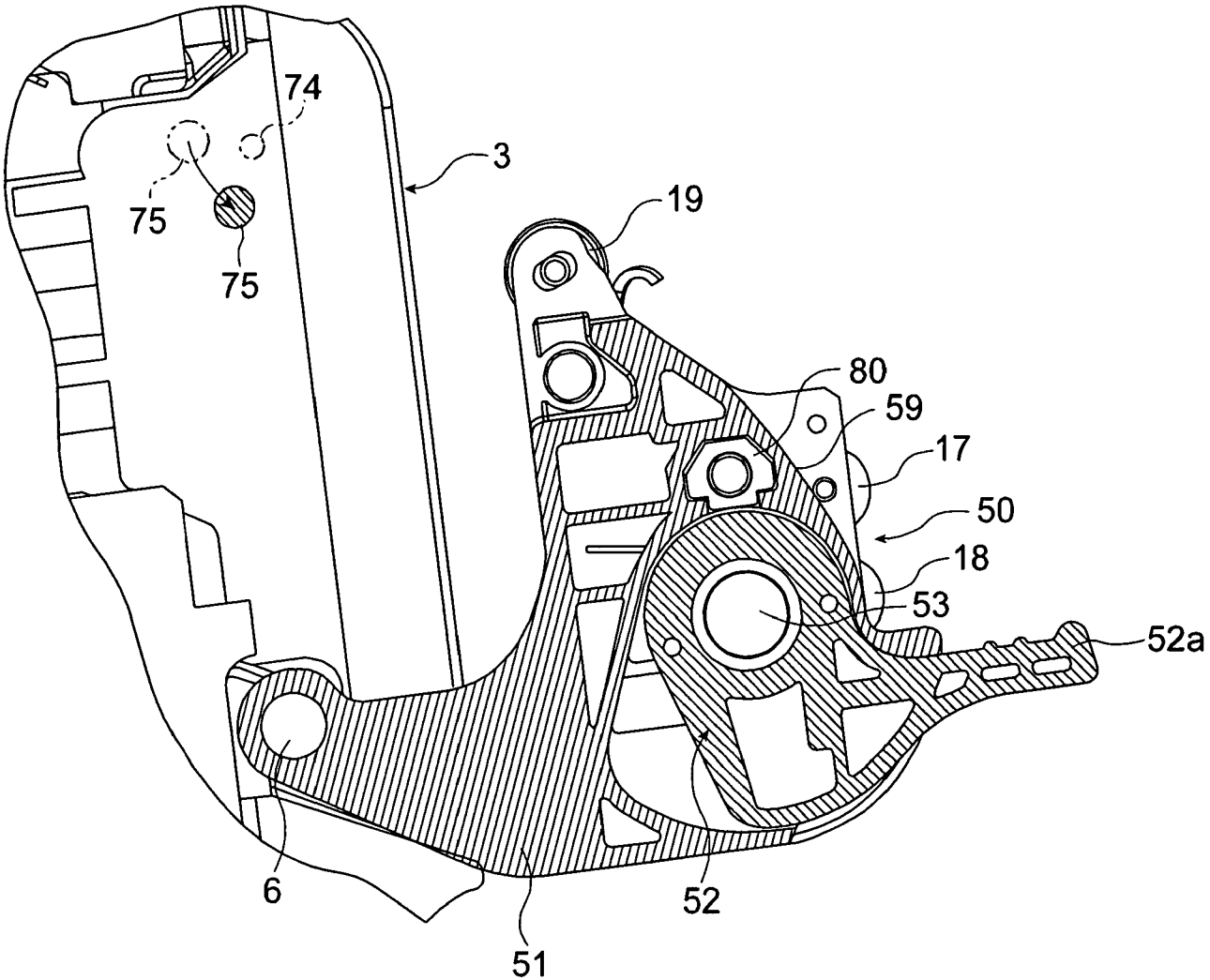

When the peeling unit 50 is opened, the pin 75 is released from the cam channel 59 and freed as shown in FIG. 10. When the pin 75 is free, the shutter 70 turns counterclockwise as seen in FIG. 11, and the straight wall 71 comes to the front thus opening the entrance to the recessed portion 61.

The shutter 70, pin 75, and cam channel 59 in the label printer 1 according to this embodiment thus form an operation limiting mechanism wherein the shutter 70 moves to a position opening the entrance to the recessed portion 61 when the peeling unit 50 is opened, thus enabling operating the printer cover release lever 60. On the other hand, the shutter 70 moves to a position closing the opening to the recessed portion 61 when the peeling unit 50 is closed, thus disabling operating the printer cover release lever 60.

Furthermore, a mode selection switch 202 is disposed in the label printer 1 according to this embodiment at a position where the switch can only be operated when the peeling unit 50 is open as shown in FIG. 3. More particularly, the mode selection switch is disposed inside the printer housing 2 at a position where the switch is exposed when the peeling unit 50 is open and hidden when the peeling unit 50 is closed. This mode selection switch 202 can only be operated when the peeling unit 50 is opened to change the label dispensing mode from peeling mode to non-peeling mode or vice versa.

When the label dispensing mode is changed by changing the transport path to which the web liner 101 is loaded, a control unit (not shown in the figure) inside the printer housing 2 recognizes the mode change and changes paper transport control and printing control. The mode selection switch 202 is a manual switch for reporting this mode change (that is, which label dispensing mode is set) to a host computer, and can send a selection signal corresponding to the selected label dispensing mode based on the position of the switch to the host computer.

The mode selection switch 202 can be disposed on the printer housing 2 for applications in which the label dispensing mode is not frequently changed. In another case, the mode selection switch 202 is preferably disposed at the front of the printer housing 2 and a marking indicating the mode selection is provided on the printer housing 2 so that the user can easily visualize which mode is selected from the position of the mode selection switch 202. So that the user does not accidentally operate the switch, the mode selection switch 202 is further preferably located inside (that is, in a recess) in the printer housing 2.

The position of the mode selection switch 202 can be visually confirmed from a mode indicator (display means) 205 disposed at the front or other external part of the printer housing 2. This mode indicator 205 can be disposed anywhere on the outside where the mode indicator 205 is visible when the peeling unit 50 is closed, and the mode indicator 205 can be a mechanical (position) indicator or an electrical indicator using LEDs, for example. A feed switch 200 (label feed switch) is also provided.

Operation of a label printer 1 according to this embodiment of the invention is described next.

When the label dispensing mode is set to the peeling mode, the label printer 1 of this embodiment intermittently advances the label paper 100, i.e., conveys the labels 102, one at a time, while printing the labels 102 by means of the print head 13 as shown in FIG. 6 and FIG. 12A.

The label paper 100 is then conveyed with the back of the web liner 101 pressed against and curving acutely around the peeling edge of the web-bending guide 14 of the peeling unit 50, and the labels 102 are peeled from the web liner 101 travelling through this curved path.

After being peeled from the web liner 101, the printed labels 102 then travel through the label-guiding path 21 and are discharged through the label dispensing slot 8 and detected by the peeled-label detector 400 while the web liner 101 passes through the web-guiding path 22 and is discharged through the web discharge slot 7.

Based on the detection result from the peeled-label detector 400, the controller (not shown in the figure) inside the printer housing 2 controls the paper transportation and printing operations, and sends the detection result (whether there is a peeled label or not) to the host computer.

More specifically, the label printer 1 remains in a standby state as long as the peeled-label detector 400 detects that a peeled label 102 is in the label dispensing slot 8. The peeled-label detector 400 senses when the user removes the label 102. The platen roller 12 then turns and the print head 13 prints the next label 102, which is likewise conveyed to the label dispensing slot 8. Sending the detection result of the peeled-label detector 400 to the host computer enables prompting the user to remove the printed label 102 and controlling the timing at which the print data for the next label is sent to the label printer 1.

The user also periodically cuts the waste web discharged from the web discharge slot 7 using the web cutter 27 so that the waste web does not get in the way.

If the label dispensing mode is set to the non-peeling mode, the labels 102 are printed continuously by the print head 13 while the label paper 100 is continuously conveyed in the state shown in FIG. 12B. The printed label paper 100 then passes through the label-guiding path 21 and is discharged through the label dispensing slot 8. The web liner 101 of the printed label paper 100 can be cut to a desired length as needed using the manual cutter 28.

In the non-peeling mode, the peeled-label detector 400 is not used.

To change the label dispensing mode the printer cover 3 is left closed and only the peeling unit 50 is opened. The part indicated by the dotted line in FIG. 12A shows the peeling unit 50 when open, and the solid line part shows the peeling unit 50 closed. Opening only the peeling unit 50 opens both the label-guiding path 21 and the web-guiding path 22, and makes changing the path to which the label paper 100 is loaded easy. More specifically, the web liner 101 of the label paper 100 is fed through the web-guiding path 22 to set the peeling mode, and through the label-guiding path 21 to set the non-peeling mode.

The printer cover 3, which requires much space to open, therefore does not need to be opened to change the label dispensing mode, a small working area is sufficient to open and close the peeling unit, and operation is simple.

The user can also perform all operations from the printer cover side (front side) of the label printer 1 that is normally seen when the printer is used, and productivity is thus improved. Because opening the printer cover 3 is not necessary, the label paper 100 remains held by the print head 13 and platen roller 12, the position of the label 102 does not change, and printing can resume soon after the label dispensing mode has been changed. opening the printer cover 3 is only necessary when wide access to the inside of the printer housing 2 is needed, such as when label paper needs to be replaced.

Furthermore, by providing a shutter 70 to this label printer 1, the release lever 60 of the printer cover 3 cannot be operated unless the peeling unit 50 is open, and the operating sequence of opening the printer cover 3 after opening the peeling unit 50 is automatically enforced.

More specifically, opening the printer cover 3 is only possible after the peeling unit 50 has been opened first, the label-guiding path 21 and web-guiding path 22 are opened, and the leading end portion of the label paper 100 is released. This eliminates the leading end of the label paper 100 held in the peeling unit 50 from being unnecessarily pulled out as a result of accidentally opening the printer cover 3, and thus eliminates waste of labels 102.

More particularly, a detector 110 for detecting the label position can be disposed upstream of the printing mechanism as shown in FIGS. 12A and 12B so that the position of a label 102 can be detected while advancing the label paper 100, and the label 102 can thus be desirably positioned. In general, the leading edge of the label 102 is positioned at the print head 13 so that printing can proceed from the leading edge of the label 102 when print data is received from the host computer for the next the label 102, and the printer then waits.

If the label 102 is not correctly positioned, the label paper 100 must be conveyed again to realign the label 102 with the print head 13, and label paper 100 is thus wasted.

When the label paper 100 is to be set into the peeling mode, only the web liner 101 is threaded into the web-guiding path 22 as shown in FIG. 12A, at least the first label 102 must be removed from the leading end of the label paper. The reason that only the web liner 101 can be fed through the web-guiding path 22 is that the paper transportation load is high around the web-bending guide 14, and there is not enough power to convey thick paper such as label paper 100 having labels 102 affixed thereto between the platen roller 12 and peeling roller 19 in the web-guiding path 22. In addition, the labels 102 tend to separate from the web liner 101 and stick in the web-guiding path 22, and paper jam thus occurs easily.

During operation the user cannot get a hold of and operate the printer cover release lever 60 when the shutter 70 has closed the recessed portion 61 as shown in FIG. 8, rather the printer cover release lever 60 can only be operated when the shutter 70 is open as shown in FIG. 11.

Undesirable operation can thus be reliably prevented by means of a simple construction. Furthermore, because a shutter 70 that indicates whether operation of the printer cover release lever 60 is allowed or not allowed is disposed where the user can directly apply force with a finger, the printer cover release lever 60 cannot be mistakenly operated and excess force will not be applied to the printer cover 3.

Furthermore, because the peeling unit 50 is assembled to the printer cover 3 in this embodiment, opening the printer cover 3 opens the label paper compartment 4 of the printer housing 2 and exposes the peeling unit 50 from the printer housing 2.

This makes loading the label paper 100 to the label printer 1, and removing web liner 101 and labels 102 jammed in the label-guiding path 21 or web-guiding path 22 of the peeling unit 50, easier.

Furthermore, by assembling the platen roller 12 of the printing mechanism 40 on the printer cover side, opening the printer cover 3 opens the label paper transport path 11 between the print head 13 and platen roller 12, enables the leading end of the label paper 100 to be passed through the printing mechanism 40, and improves the ease of removing label paper 100 jammed in the transport path 11 if a paper jam occurs.

Furthermore, the peeling unit 50 can be held in the closed position in a label printer 1 according to this embodiment because the peeling roller 19 of the peeling unit 50 engages the outer surface of the platen roller 12.

The label printer 1 in the foregoing embodiment of the invention is described as having a shutter 70 as the operation limiting means for restricting the opening operation of the printer cover release lever 60. Instead, a locking member that moves to a position allowing or not allowing operation of the opening operator in conjunction with the opening and closing operation of the peeling mechanism can be used.

Furthermore, a printing mechanism 40 having a print head 13 is described in the foregoing embodiments, but printing mechanisms using an inkjet print head or other type of print head can be used alternatively.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

The invention claimed is:

1. A label printer including a compartment for storing a web liner to which a plurality of labels are affixed, comprising:

a printing mechanism configured to convey the web liner from the compartment and to print on the labels;

a cover mounted for opening and closing the compartment;

a label peeling mechanism configured to peel labels from the web liner by bending the web liner acutely, wherein the label peeling mechanism is attached to the cover for movement between an open position and a closed position relative to the cover;

an opening operator for opening the cover; and an operation limiting mechanism disposed in or on the opening operator, the operation limiting mechanism configured to enable operation of the opening operator when the label peeling mechanism is in the open position and to disable operation of the opening operator when the label peeling mechanism is in the closed position.

2. A label printer as described in claim 1, wherein the operation limiting mechanism comprises a shutter configured to move to a first position enabling operation of the opening operator and to a second position disabling operation of the opening operator.

3. A label printer as described in claim 1, wherein the label peeling mechanism is further configured to direct the labels peeled from the web liner to a label-guiding path terminating in a label dispensing opening and to direct the web liner from which labels have been peeled to a web- guiding path terminating in a web discharge opening, wherein movement of the label peeling mechanism to the open position exposes the label-guiding and web-guiding paths.

4. A label printer as described in claim 3, further comprising a lock mechanism configured to lock the label peeling mechanism in the closed position with respect to the cover.

5. A label printer as described in claim 1, further comprising a printer housing, and wherein the printing mechanism comprises:

a thermal head mounted on or in the printer housing and configured to print on the labels, and a platen roller mounted on the cover and configured to press the web liner and labels affixed thereto to the thermal head.

6. A label printer as described in claim 5, wherein the platen roller is mounted on a side of the cover, so that opening the cover exposes at least a portion of a transportation path, through which the web liner with labels affixed thereto is conveyed, between the thermal print head and the platen roller.

7. A label printer as described in claim 1, further comprising a detector configured to detect a label position upstream of the printing mechanism.

* * * * *